US009528341B2

(12) United States Patent
Slup

(10) Patent No.: US 9,528,341 B2
(45) Date of Patent: Dec. 27, 2016

(54) CONTINUOUS EXPANDABLE BACKUP RING FOR A SEAL WITH RETRACTION CAPABILITY

(71) Applicant: BAKER HUGHES INCORPORATED, Houston, TX (US)

(72) Inventor: Gabriel A. Slup, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 301 days.

(21) Appl. No.: 14/224,271

(22) Filed: Mar. 25, 2014

(65) Prior Publication Data

US 2015/0275619 A1 Oct. 1, 2015

(51) Int. Cl.
*E21B 33/12* (2006.01)

(52) U.S. Cl.
CPC ..... *E21B 33/1216* (2013.01)

(58) Field of Classification Search
CPC ..... E21B 33/1216; F16F 1/045; F16F 1/047; F16F 1/08; F16F 1/122; F16F 1/8123; F16F 1/12; F16F 1/042
See application file for complete search history.

(56) References Cited

U.S. PATENT DOCUMENTS 40,452 A * 11/1863 Allen ..... F16F 1/08 267/166.1
2,650,086 A * 8/1953 Sjolander ..... F01L 1/462 267/135
2,921,632 A * 1/1960 Clark, Jr. ..... E21B 33/1216 277/338
5,165,703 A * 11/1992 Morvant ..... E21B 33/1208 277/342
7,806,177 B2 10/2010 Bishop et al.
8,307,891 B2 11/2012 Bishop et al.
8,561,689 B2 10/2013 Nutley et al.
2004/0007366 A1* 1/2004 McKee ..... E21B 33/1216 166/387
2013/0147121 A1 6/2013 Xu
2013/0306330 A1 11/2013 Bishop et al.

FOREIGN PATENT DOCUMENTS

WO 9835130 A1 8/1998

* cited by examiner

*Primary Examiner* — Jennifer H Gay
*Assistant Examiner* — Steven MacDonald
(74) *Attorney, Agent, or Firm* — Steve Rosenblatt

(57) ABSTRACT

The extrusion barrier for a sealing element for a packer or bridge plug is energized when set to store a retractive force that can be deployed when the packer or plug is released. The structure is a coiled spring that has gaps in the run in position and has a relaxed diameter smaller than the borehole or surrounding tubular dimension. When the packer is set a cone acts in conjunction with the spring to compress the coils together into contact while increasing the diameter to bridge an annular gap to act as an extrusion barrier. In the set position there is a restorative potential energy force that when the spring is allowed to relax retracts the shape back to the run in shape for removal of the packer or plug. Some of the trailing end coils are of a smaller diameter so that the structure can be clamped there for forcible axial movements in opposed directions.

19 Claims, 2 Drawing Sheets

CONTINUOUS EXPANDABLE BACKUP RING FOR A SEAL WITH RETRACTION CAPABILITY

FIELD OF THE INVENTION

The field of the invention is continuous expandable backup rings for seals and more particularly for packer seals where the packer is resettable or retrievable and the backup rings store a potential energy force to aid in retraction.

BACKGROUND OF THE INVENTION

Packer seals are subjected to differential pressures when set. The differential pressure creates shear forces in the seal material that can be significant enough to cause extrusion of the seal material in the axial direction. To address this issue extrusion rings have been used. These rings are disposed on opposed ends of the seal assembly for a packer and are typically overlapping rings that deform to span an annular gap as the seal assembly is either mechanically compressed or swells in the presence of a predetermined fluid that is found at the packer location. Generally the backup rings are deformed plastically to span the annular gap with the seal. In most applications the packer or bridge plug is not design to be retrieved so issues with release of the backup rings do not arise. However, if the packer is to be retrieved and the mechanically compressing force that holds the sealing element in the set position is released, the backup rings continue in their set position. When an attempt is made to move the now unset packer there is a possibility that the backup rings could bend and deform in a manner that would either require destroying the backup rings or facing a situation where the released packer is jammed with contorted backup rings forcing a release from the packer and a subsequent very expensive milling operation.

Various designs for extrusion barriers or backup rings have been tried in the past. In some applications extending members act as debris barriers to protect mechanical components of the slips from jamming with debris and thus preventing a release. These devices are generally not immediately next to the seal assembly and are more often spaced a short distance from the slips and seal assembly of the packer and are on the uphole side of the packer to prevent settling debris from getting into the packer mechanical parts after a long period where the packer can be set in the hole. Extrusion barriers are used with inflatable elements as well as mechanically compressed elements.

U.S. Pat. No. 8,561,689 shows a stack of rings that are bent into position as the sealing element swells to the set position. U.S. Pat. Nos. 7,806,177 and 8,307,891 show an array of pivoting segments to act as extrusion barriers that are secured to a slip ring so that the segments can move radially out or in with the movement of the segments of the slip ring. US 2013/0306330 uses ring segments associated with the slips to in turn reshape a round profile backup ring into an oval profile for backing up the sealing element. US2013/0147121 shows a flexible ring that is retained by opposed axially movable end rings. The backup ring moves out radially when the end rings are brought together and is forcibly retracted when the end rings move axially away from each other. Finally, WO98/35130 shows the use of articulated linkages that move radially into an anti-extrusion position when the sealing element is compressed and whose motion reverses when the bridge plug is extended to reverse.

These designs have several shortcomings. Many simply plastically deform and are not functional for another set and may actually get bent or crack under stress imposed in the set position so that attempts to get such designs to release can be futile. This means that the packer may need to be drilled out. Segmented back up rings have gaps between the segments, creating an extrusion gap, especially in high pressure high temperature applications. Some of these designs are forcibly retracted which again presents the risk of cracks at stress concentration locations and a subsequent contorting of the ring structure so as to make the packer or bridge plug hard or impossible to remove. What is needed and provided by the present invention is an expandable continuous extrusion barrier that acts as a spring in the manner that it has an open coiled structure for running in and when set the gaps between the coils close and the diameter can increase while keeping the stress within tolerable limits. The extrusion barrier can retract its original shape after the external force is removed. The structure can be forced radially outwardly on a ramp such as a cone and the resulting deformation is elastic. When the borehole wall or surrounding tubular is reached the leading coils conform to the wall shape and the coil gaps are closed. At the same time, a restoring potential energy force is stored in the set position so that on release of the packer the potential energy force acts to push the barrier back down the ramp while also urging the shape to retract radially inwardly to facilitate removal of the packer or plug. Those and other aspects of the present invention will be more readily apparent to those skilled in the art from a review of the detailed description of the preferred embodiment and the associated drawings while recognizing that the full scope of the invention is to be determined by the appended claims.

SUMMARY OF THE INVENTION

The extrusion barrier for a sealing element for a packer or bridge plug is energized when set to store a retractive force that can be deployed when the packer or plug is released. The structure is a coiled spring that has gaps in the run in position and has a relaxed diameter smaller than the borehole or surrounding tubular dimension. When the packer is set a cone acts in conjunction with the spring to compress the coils together into contact while increasing the diameter to bridge an annular gap to act as an extrusion barrier. In the set position there is a restorative potential energy force that when the spring is allowed to relax retracts the shape back to the run in shape for removal of the packer or plug. Some of the trailing end coils are of a smaller diameter so that the structure can be clamped there for forcible axial movements in opposed directions.

DETAILED DESCRIPTION OF THE PREFERRED EMBODIMENT

Figure 1:
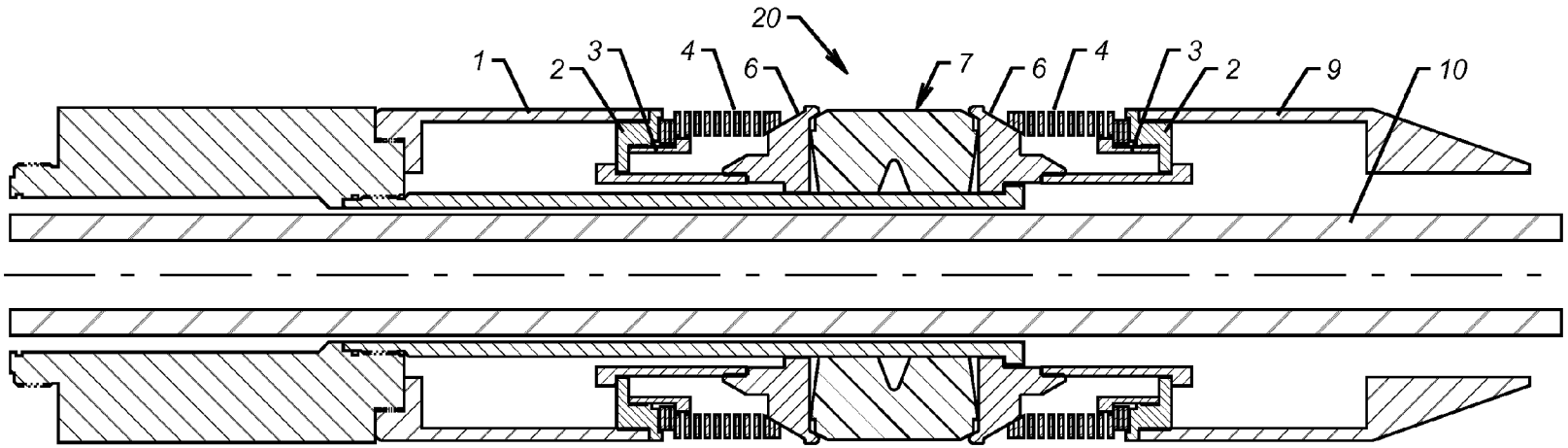
FIG. 1 is a section view of a retrievable packer in the run in position.
Figure 2:
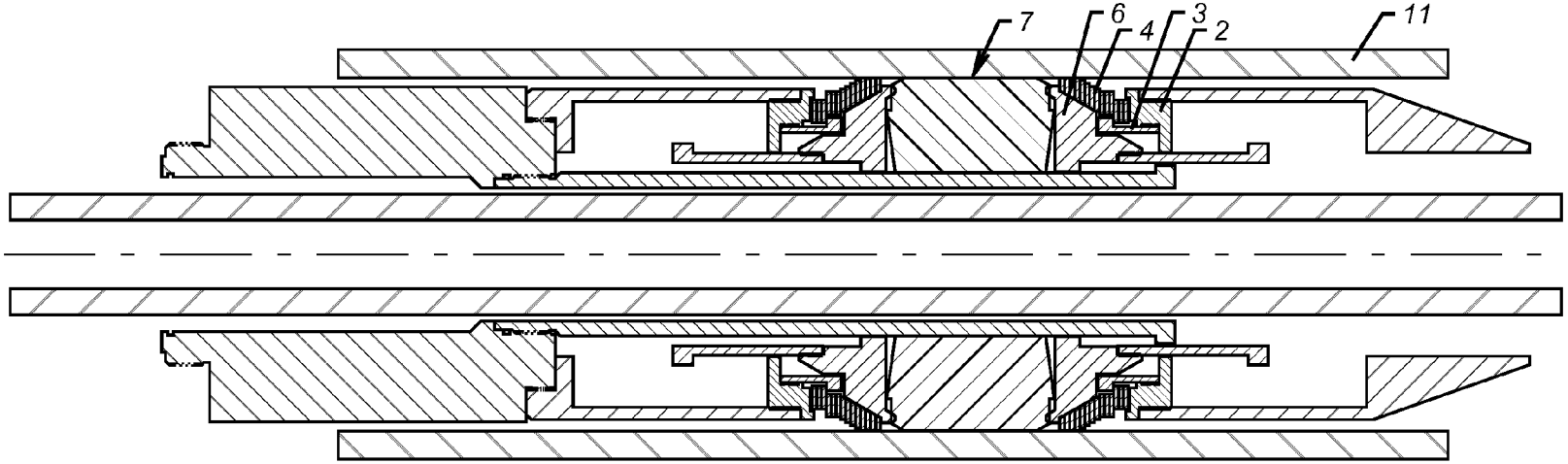
FIG. 2 is the view of FIG. 1 in the set position.
Figure 4:
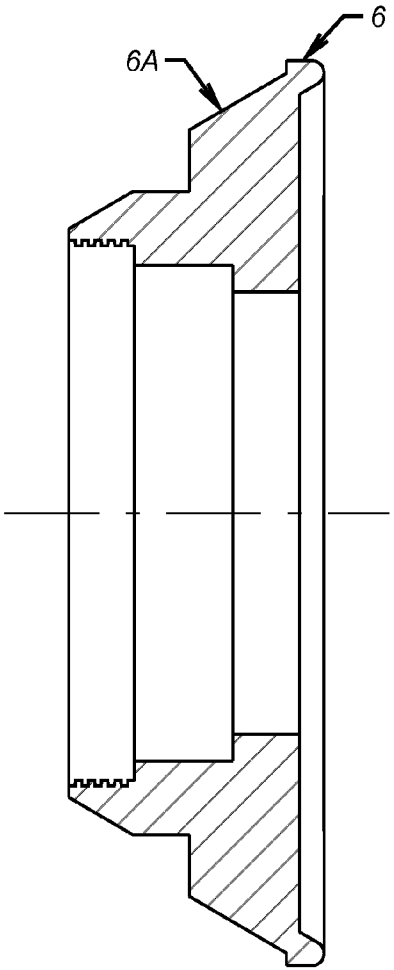
FIG. 4 is a section view of a cone on which the barrier of FIG. 3 rides up and out for the set position.
Figure 3:
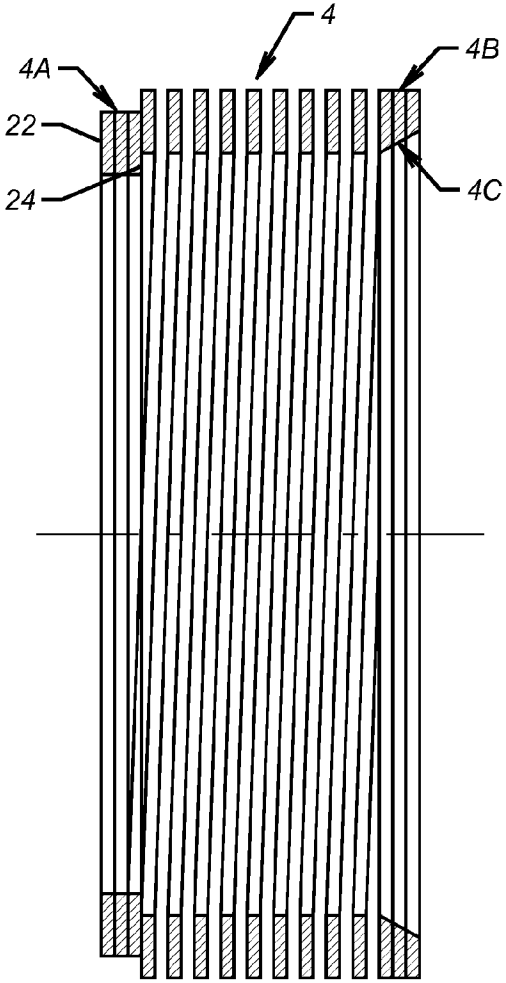
FIG. 3 is a section view of the extrusion barrier in the run in position.

Referring to FIG. 1 the mandrel 10 has an outer assembly 20 that features a sealing element assembly 7 with gage rings 6 on opposed ends. FIG. 4 shows the rings 6 in more detail as having a ramp surface 6A on which the spring 4 will ride up and out when moved axially by ring 1 being moved toward ring 9. Each of rings 1 and 9 have a nut 2 and a retainer 3 that is threaded onto its respective nut 2 so that surfaces 22 and 24 shown in FIG. 3 can be retained. The upper ring 1 moves during the setting while ring 9 remains stationary. The springs 4 first have the coils pushed against one another to close the gaps in between and then the collapsed spring using surface 4C riding up and out on surface 6A results in contact with the surrounding tubular such as 11 as shown in FIG. 2.

Those skilled in the art will appreciate that the anti-extrusion device in the form of a coiled spring offers several advantages. Its open structure between coils when being run in allows it to flex in axial compaction as well as radially to reach the borehole wall whether it is a tubular or an open hole. The continuous shape of the deployed spring free end 4B eliminates any potential sealing element extrusion gaps. There are reduced possibilities of stress concentration such as when compared to a solid ring that is reshaped to span an annular gap. The strength of the spring determines whether it fully compresses first before being driven out radially or whether both events happen at the same time. The nature of the coiled spring is such that as the coils are opened when driven along sloping surface 6A they build a restorative potential energy that seeks to retract such radially expanded coils back down ramp 6A should that opportunity be present. The fact that the coils are axially compacted and radially expanded in the elastic range means that the potential energy that is available from attaining the set position is on tap to aid in the restoring of the springs 4 to their run in position. The movement of the nut 2 with retainer 3 can also exert a restorative force on the springs 4 to get them back into the FIG. 1 run in position. The nature of the coiled spring shape also means that should the borehole inside dimension be irregular that the springs 4 can elastically distort to conform to the contours of the borehole shape. Optionally, the springs 4 can be coated with a resilient material that can aid in the resistance to extrusion by making more intimate contact with the surrounding borehole wall despite dimensional irregularities that it might have. The run in diameter is smaller than the gage rings 6 to avoid snagging the springs 4 when running in.

The above description is illustrative of the preferred embodiment and many modifications may be made by those skilled in the art without departing from the invention whose scope is to be determined from the literal and equivalent scope of the claims below:

I claim:

1. A retrievable apparatus for forming a seal against a borehole wall, comprising:

a mandrel;

a sealing assembly on said mandrel operable between a run in and a set position for sealing against the borehole wall and release from the borehole wall;

an anti-extrusion assembly on said mandrel operable between a run in and a set position, said anti-extrusion assembly storing potential energy force in said set position that acts in a direction to move said anti-extrusion assembly toward said run in position when said force is released;

said anti-extrusion assembly having a larger initial internal diameter at a first end closer to said sealing assembly than a second internal diameter located adjacent an opposite end thereof said second internal diameter defined by, opposed surfaces clamped toward each other with a clamp for guided opposed axial relative movement with respect to said mandrel.

2. The apparatus of claim 1, wherein:

said anti-extrusion assembly comprises at least one gap in said run in position that closes in said set position.

3. The apparatus of claim 1, wherein:

said anti-extrusion assembly comprises a continuous coil with a quadrilateral wire shape allowing adjacent windings to contact each other in a plane.

4. The apparatus of claim 1, wherein:

said anti-extrusion assembly has an annular shape.

5. The apparatus of claim 1, wherein:

said anti-extrusion assembly is driven on a ramp surface toward the borehole wall for said set position.

6. The apparatus of claim 5, wherein:

said ramp is integrally formed on a gage ring adjacent said sealing assembly.

7. The apparatus of claim 1, wherein:

said anti-extrusion assembly is disposed on opposed sides of said sealing assembly.

8. The apparatus of claim 1, wherein:

said anti-extrusion assembly comprises at least one coiled spring.

9. The apparatus of claim 8, wherein:

said spring is pushed from a first end to go up a ramp at a second end of said spring.

10. The apparatus of claim 9, wherein:

said potential energy in said spring forces a free end of said spring down a ramp.

11. The apparatus of claim 8, wherein:

said spring further comprises a resilient coating.

12. The apparatus of claim 8, wherein:

said spring comprises spaced coils that contact as or before said spring is forced along a ramp.

13. The apparatus of claim 8, wherein:

said spring moves radially in different amounts along its length.

14. The apparatus of claim 8, wherein:

said spring takes the shape of the borehole wall when axially displaced along a ramp.

15. The apparatus of claim 8, wherein:

said spring is axially translated to make said spring move radially toward said borehole wall.

16. The apparatus of claim 8, wherein:

said spring has a free end that selectively moves along a ramp.

17. The apparatus of claim 8, wherein:

said spring before axial compression has an inner tapered surface matching the ramp taper.

18. The apparatus of claim 8, wherein:

in the deployed position, said spring has a continuous surface facing the sealing element.

19. A method of impeding fluid flow in a wellbore using the apparatus of claim 1.

* * * * *